US009440662B2

(12) United States Patent
Kamaka et al.

(10) Patent No.: US 9,440,662 B2
(45) Date of Patent: Sep. 13, 2016

(54) MULTI-LAYERED WINDOW STRUCTURE

(75) Inventors: Tomonori Kamaka, Yachiyo (JP); Yoji Shimokawa, Funabashi (JP); Susumu Inagaki, Yachiyo (JP); Hirohiko Kakinuma, Sapporo (JP); Iwao Sato, Sapporo (JP); Tomoaki Kito, Sapporo (JP)

(73) Assignees: TOHO SHEET & FRAME CO., LTD, Tokyo (JP); HOKKAIDO RAILWAY COMPANY, Sapporo-Shi (JP)

( * ) Notice: Subject to any disclaimer, the term of this patent is extended or adjusted under 35 U.S.C. 154(b) by 54 days.

(21) Appl. No.: 13/696,509

(22) PCT Filed: Jul. 22, 2010

(86) PCT No.: PCT/JP2010/062323

§ 371 (c)(1),
(2), (4) Date: Feb. 14, 2013

(87) PCT Pub. No.: WO2012/011177

PCT Pub. Date: Jan. 26, 2012

(65) Prior Publication Data

US 2013/0236661 A1 Sep. 12, 2013

(51) Int. Cl.
*B61D 25/00* (2006.01)
*B63B 29/00* (2006.01)
(Continued)

(52) U.S. Cl.
CPC ..... *B61D 25/00* (2013.01); *B63B 29/00* (2013.01); *E04C 2/54* (2013.01); *E06B 3/24* (2013.01); *E06B 3/66* (2013.01); *E06B 3/5427* (2013.01); *E06B 3/677* (2013.01); *E06B 7/12* (2013.01)

(58) Field of Classification Search
CPC ..... E06B 3/6617; E06B 3/663
See application file for complete search history.

(56) References Cited

U.S. PATENT DOCUMENTS 4,027,443 A * 6/1977 Briggs ..... 52/202
4,232,492 A * 11/1980 Remick et al. ..... 428/34
(Continued)

FOREIGN PATENT DOCUMENTS

CN 2537548 Y 2/2003
CN 201037357 Y 3/2008
(Continued)

OTHER PUBLICATIONS

[NPL-1] Bally, M.; GlassonWeb (May 2007), <http://www.glassonweb.com/articles/utils/print.php?id=410>.*
(Continued)

*Primary Examiner* — David Sample
*Assistant Examiner* — Donald M Flores, Jr.
(74) *Attorney, Agent, or Firm* — Leason Ellis LLP

(57) ABSTRACT

A multi-layered window structure of the present invention includes: a first window pane made of glass; a second window pane made of polycarbonate, being smaller in both height and width than the first window pane, and formed to a thickness of 5 mm to 30 mm; a hollow annular spacer disposed so as to extend along edges of the first window pane and the second window pane, and having holes in a side wall facing an air layer between the first window pane and the second window pane; and a primary sealer being an elastic body, with a thickness of 0.5 mm or more and a width of 6 mm or more, that extends along the edges of the first window pane and the second window pane, and is disposed between the first window pane and the spacer, and between the second window pane and the spacer.

14 Claims, 6 Drawing Sheets

(51) Int. Cl.

| | |
|---|---|
| ***E04C 2/54*** | (2006.01) |
| ***E06B 3/24*** | (2006.01) |
| ***E06B 3/66*** | (2006.01) |
| *E06B 7/12* | (2006.01) |
| *E06B 3/54* | (2006.01) |
| *E06B 3/677* | (2006.01) |

(56) References Cited

U.S. PATENT DOCUMENTS

| | | | | |
|---|---|---|---|---|
| 4,261,145 | A * | 4/1981 | Brocking | 52/172 |
| 4,368,226 | A * | 1/1983 | Mucaria | 428/34 |
| 4,615,159 | A * | 10/1986 | Kessler | 52/171.3 |
| 4,887,402 | A * | 12/1989 | Da Col | 52/235 |
| 4,998,382 | A * | 3/1991 | Kostos et al. | 49/501 |
| 5,199,236 | A * | 4/1993 | Allen | 52/235 |
| 5,237,787 | A * | 8/1993 | Grether et al. | 52/171.3 |
| 5,373,672 | A * | 12/1994 | Schulz | 52/235 |
| 5,460,862 | A * | 10/1995 | Roller | 428/35.7 |
| 5,553,440 | A * | 9/1996 | Bulger et al. | 52/786.13 |
| 5,593,784 | A * | 1/1997 | Chinzi | 428/413 |
| 5,655,282 | A * | 8/1997 | Hodek et al. | 29/469.5 |
| 5,675,944 | A * | 10/1997 | Kerr et al. | 428/34 |
| 6,055,783 | A * | 5/2000 | Guhl et al. | 428/34 |
| 6,105,336 | A * | 8/2000 | Katoh et al. | 428/34 |
| 6,309,755 | B1 * | 10/2001 | Matsco et al. | 428/451 |
| 6,339,909 | B1 * | 1/2002 | Brunnhofer et al. | 428/34 |
| 6,345,485 | B1 * | 2/2002 | Boone et al. | 52/786.13 |
| 2004/0259475 | A1 * | 12/2004 | Vianello et al. | 451/5 |
| 2005/0126091 | A1 * | 6/2005 | Sherrett et al. | 52/204.6 |
| 2005/0132663 | A1 * | 6/2005 | Guhl et al. | 52/204.62 |
| 2006/0121315 | A1 * | 6/2006 | Myli et al. | 428/702 |
| 2007/0003717 | A1 * | 1/2007 | Kawasaki et al. | 428/34 |
| 2007/0116907 | A1 * | 5/2007 | Landon et al. | 428/34 |
| 2007/0122588 | A1 * | 5/2007 | Milburn | 428/117 |
| 2007/0160781 | A1 * | 7/2007 | Landon et al. | 428/34 |
| 2007/0178256 | A1 * | 8/2007 | Landon | 428/34 |
| 2007/0178257 | A1 * | 8/2007 | Landon | 428/34 |
| 2008/0020154 | A1 * | 1/2008 | Landon et al. | 428/34 |
| 2008/0145661 | A1 * | 6/2008 | Medwick et al. | 428/409 |
| 2009/0139163 | A1 * | 6/2009 | Prete et al. | 52/204.593 |
| 2009/0139164 | A1 * | 6/2009 | Prete et al. | 52/204.593 |
| 2009/0139165 | A1 * | 6/2009 | Prete et al. | 52/204.593 |
| 2010/0098888 | A1 * | 4/2010 | Landon et al. | 428/34 |

FOREIGN PATENT DOCUMENTS

| | | | | |
|---|---|---|---|---|
| CN | 101410338 | A | 4/2009 | |
| DE | 102007005757 | A1 * | 8/2008 | E06B 3/66 |
| EP | 0241665 | A | 10/1987 | |
| EP | 0515953 | A | 12/1992 | |
| EP | 0601488 | A | 6/1994 | |
| FR | 2166035 | A | 8/1973 | |
| JP | 61-191546 | A | 8/1986 | |
| JP | 62-096167 | A | 5/1987 | |
| JP | 11-107644 | A | 4/1999 | |
| JP | 3645874 | B | 5/2005 | |
| JP | 2007-277052 | A | 10/2007 | |
| JP | 2008-068707 | A | 3/2008 | |

OTHER PUBLICATIONS

Hauser, H. et al. (DE 102007005757 A1); (Aug. 2008), [EPO machine translation to English].*

International Search Report mailed Sep. 28, 2010 for the corresponding PCT Application No. PCT/JP2010/062323.

Office Action of the Japanese Application No. 2002-239474 mailed Sep. 28, 2004 with a title: Double Window Structure for Vehicle.

European Search Report mailed Dec. 16, 2013 for the corresponding European Application No. 10855014.6.

Office Action mailed Jul. 29, 2014 for the corresponding Chinese Application No. 201080066740.5.

* cited by examiner

MULTI-LAYERED WINDOW STRUCTURE

CROSS-REFERENCE TO RELATED PATENT APPLICATIONS

This application is a U.S. National Phase Application under 35 U.S.C. §371 of International Patent Application No. PCT/JP2010/062323, filed Jul. 22, 2010, which is incorporated by reference herein. The International Application was published in Japanese on Jan. 26, 2012 as International Publication No. WO/2012/011177 under PCT Article 21(2).

FIELD OF THE INVENTION

The present invention relates to a multi-layered window structure.

BACKGROUND ART OF THE INVENTION

In recent years, as a window structure for railroad cars that run at high speed, a multi-layered window is known in which an air layer is provided between two transparent panes in order to provide sound insulation and thermal insulation (refer to Patent Document 1). In such a multi-layered window, since the pressure difference between the inside pressure and the outside pressure on the air layer changes greatly, it is supported by a frame material. Furthermore, a sealer, a polymeric coating film, or the like is disposed between the frame material and the multi-layered window in order to make the air layer airtight.

Moreover, in recent years, developments of high speed railroad cars are progressed, and large window panes therefor have become required in order to have good view from the cars. However, there is a problem in that when travelling at high speed in a cold region, breakage and condensation of window panes are likely to occur. For example, if snow attaches beneath a railroad car while travelling in a cold region and the railroad car travels through a tunnel, an updraft is generated and a stone near the track can attach to the snow beneath the railroad car. In this case, a problem can occur in which the stone is lifted up by the updraft and hits the glass window pane, and thereby damaging the glass window pane. To cope with this problem, a technique is used in which a shatterproof film is applied to the outside of the glass window pane. However, it does not completely prevent the glass window pane from being damaged. Therefore, currently, multi-layered windows are widely used in which a glass window pane and a polycarbonate window pane are combined.

Such a multi-layered window has a problem in that although breakage due to stone impact can be prevented by installing a polycarbonate window pane facing the outside of the car, condensation is likely to occur between the glass window pane and the polycarbonate window pane. Especially in a case of a large multi-layered window used in a cold region, since the difference in temperature between the inside and the outside of a car is great, condensation is likely to occur.

In order to solve this, a method is known in which desiccating agent is disposed between a first window pane and a second window pane (refer to Patent Document 2).

As shown in Patent Document 2, between a glass window pane (first window pane) and a polycarbonate window pane (second window pane), a spacer is disposed so as to extend along the edges of the first window pane and the second window pane. Furthermore, a sealer is disposed between the spacer and the first window pane, and between the spacer and the second window pane, such that they are in contact with each other, which unifies the spacer, the first window pane, and the second window pane. By means of such a construction, a sealed air layer is formed between the first window pane and the second window pane. The spacer has a hollow annular shape, and is packed with desiccating agent. Moreover, a plurality of slits is formed in the side wall on the air layer side of the spacer, so that the inside of the spacer and the air layer communicate with each other. As a result, the air layer is dehumidified by the desiccating agent.

PRIOR ART DOCUMENTS

Patent Documents

[Patent Document 1] Japanese Unexamined Patent Application, First Publication No. S62-96167

[Patent Document 2] Japanese Unexamined Patent Application, First Publication No. 2008-068707

Problems to be Solved by the Invention

However, since polycarbonate is permeable to water, it is not possible to prevent condensation occurring between the first window pane and the second window pane sufficiently even if desiccating agent is disposed therebetween. Furthermore, since there is a difference in the thermal expansion coefficients between polycarbonate and glass, in an environment where the difference in temperature between the inside and the outside of a car is great as in a cold region, the difference in thermal expansion between the first window pane made of glass and the second window pane made of polycarbonate becomes great. Therefore, the edge portion of the second window pane deforms greatly, applying stress to the sealer. As a result, the surface of the sealer bonded to the second window pane peels off, or the sealer stretches, so that there is concern about cracks or tears occurring. In such a case, moisture enters the air layer, and condensation occurs between the first window pane and the second window pane.

The present invention was made to solve the above-described problems, with an object of providing a multi-layered structure that can prevent condensation occurring between a pair of window panes.

SUMMARY OF THE INVENTION

Means for Solving the Problem

In order to achieve the above-described object, the present invention adopts the following construction.

That is, (1) a multi-layered window structure according to an aspect of the present invention comprises: a first window pane made of a glass; a second window pane made of a polycarbonate, being smaller in both height and width than the first window pane, and formed to a thickness of 5 mm to 30 mm; a hollow annular spacer disposed so as to extend along edges of the first window pane and the second window pane, and having holes in a side wall facing an air layer between the first window pane and the second window pane; and a primary sealer being an elastic body, with a thickness of 0.5 mm or more and a width of 6 mm or more, that extends along the edges of the first window pane and the second window pane, and is disposed between the first window pane and the spacer, and between the second window pane and the spacer.

(2) In the multi-layered window structure according to the above-described (1), it is preferable that the spacer is packed with a desiccating agent.

(3) In the multi-layered window structure according to the above-described (1), it is preferable that the primary sealer is made of an isobutylene-isoprene rubber.

(4) In the multi-layered window structure according to the above-described (1), it is preferable to further comprise a secondary sealer made of an elastic body, that is in contact with and extends along the edges of the first window pane and the second window pane, and is also contact with the spacer so as to surround a periphery of the spacer.

(5) In the multi-layered window structure according to the above-described (1), it is preferable that a black coating film is formed on the edge, on the air layer side, of the second window pane.

(6) In the multi-layered window structure according to any one of the above-described (1) to (5), it is preferable that within a temperature condition of 18° C. to 25° C., a center of the second window pane is curved so as to protrude away from the first window pane, by 0.1 mm to 3.0 mm in relation to a periphery of the second window pane.

Effects of the Invention

According to the aspect described above in (1), by forming the second window pane made of polycarbonate smaller in both height and width than the first window pane made of glass, it is possible to limit the range of the edge portion that deforms when the second window pane expands thermally. Furthermore, by forming the second window pane to a thickness of 5 mm to 30 mm, moisture can be prevented from permeating into the air layer. Moreover, by making the size of the primary sealer a thickness of 0.5 mm or more and a width of 6 mm or more, it is possible to prevent cracks or tears from occurring in the primary sealer even if stress is applied to the primary sealer accompanying thermal expansion of the second window pane. As a result, it is possible to prevent moisture from permeating through the second window pane, and moisture due to cracks or tears of the primary sealer from permeating. Therefore, it is possible to prevent condensation from occurring between the first window pane and the second window pane.

In the case described above in (2), since the spacer is packed with desiccating agent, it is possible to remove moisture from the air layer sealed by the first window pane, the second window pane, and the spacer. As a result, it is possible to prevent condensation from occurring between the first window pane and the second window pane more effectively.

In the case described above in (3), since the primary sealer is made of isobutylene-isoprene rubber, it is possible to prevent moisture from permeating the primary sealer. Furthermore, even if stress is applied to the primary sealer, cracks or tears are unlikely to occur, so that it is possible to prevent condensation from occurring between the first window pane and the second window pane more effectively.

In the case described above in (4), since the secondary sealer being an elastic body is in contact with and extends along the edges of the second window pane and the first window pane, and is also contact with the spacer so as to surround a periphery of the spacer, it is possible to prevent moisture from permeating into the air layer more effectively.

In the case described above in (5), since the black coating film is formed on the edge, on the air layer side, of the second window pane, it is possible to prevent the primary sealer from being exposed to sunlight. As a result, it is possible to prevent the primary sealer from deteriorating due to the sunlight and resulting in cracks or tears.

In the case described above in (6), since the center of the second window pane is curved so as to protrude away from the first window pane, by 0.1 mm to 3.0 mm in relation to the periphery of the second window pane under temperature conditions of 18° C. to 25° C., it is possible to prevent the second window pane from bending inward due to thermal expansion. As a result, this prevents the first window pane and the second window pane from making contact, which prevents the outside heat from being transmitted directly to the first window pane. Therefore, it is possible to more reliably prevent condensation from occurring due to contact between the first window pane and the second window pane.

DETAILED DESCRIPTION OF THE INVENTION

Figure 1:
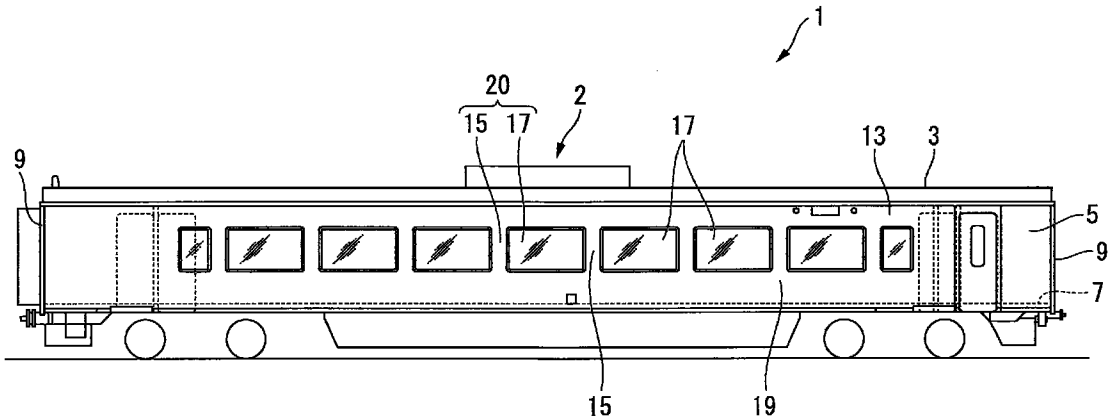
FIG. 1 is a side view of a railroad car having a multi-layered window structure according to an embodiment of the present invention.

[Best Mode for Carrying Out the Invention]

Hereunder is a description of an example in which a multi-layered window structure according to an embodiment of the present invention is used in a railroad car 1, with reference to the drawings.

In the drawings referenced in the following description, there are cases in which the characteristic parts are shown enlarged for convenience in order to make their characteristics easily understood, and the relative dimensions of each of the elements are not always the same as in real ones. Furthermore, the following description illustrates one example of the materials, dimensions, and the like. This is not a limitation of the present invention, and appropriate changes may be made provided they do not change the gist of the invention.

A multi-layered window structure 20 of the present embodiment is used for example in the railroad car 1.

First is a description of a schematic structure of the railroad car 1 in which the multi-layered window structure 20 of the present embodiment is used. As shown in FIG. 1, a car structure 2 of the railroad car 1 schematically comprises; a roof structure 3, a pair of side structures 5, an underframe 7, and an end structure 9. Among them, the underframe 7 forms a floor section, and the side structures 5 are joined to the two side sections of the underframe 7. An air conditioner for air conditioning of the compartment, and a pantograph, are installed in the roof structure 3.

The side structure 5 comprises; an upper panel 13 for example with a double skin structure in which a hollow aluminum alloy extrusion is used, a window frame panel 15, and a lower panel 19. Moreover, in the side structure 5, the window frame panel 15 is disposed such that it is sandwiched between the upper panel 13 and the lower panel 19.

Furthermore, all of the panels (i.e., the upper panel 13, the window frame panel 15, and the lower panel 19) are joined to each other.

[Multi-Layered Window Structure 20]

Figure 2:
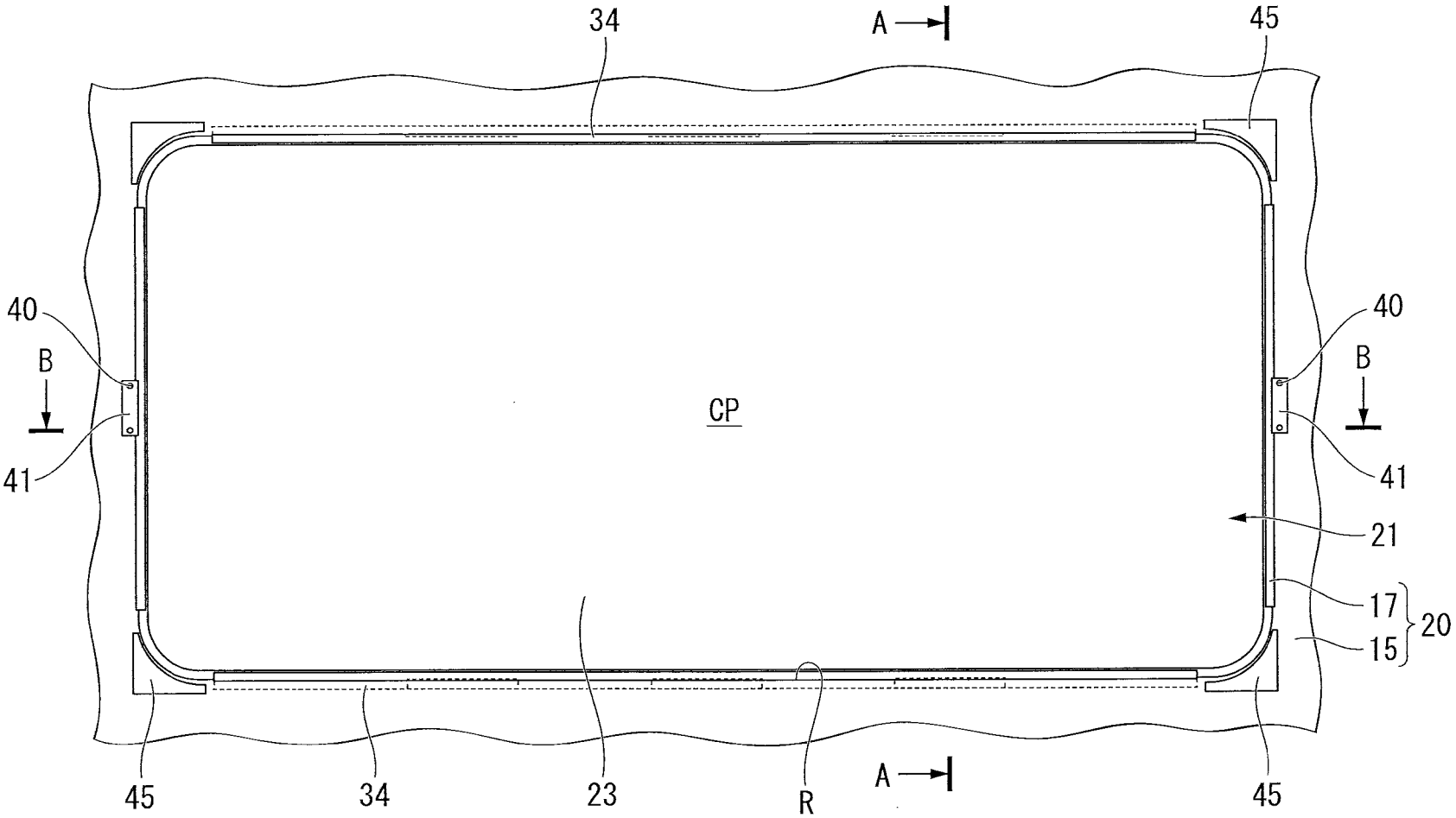
FIG. 2 is a front view of a window frame panel in which the multi-layered window structure is provided, viewed from the outside.
Figure 3:
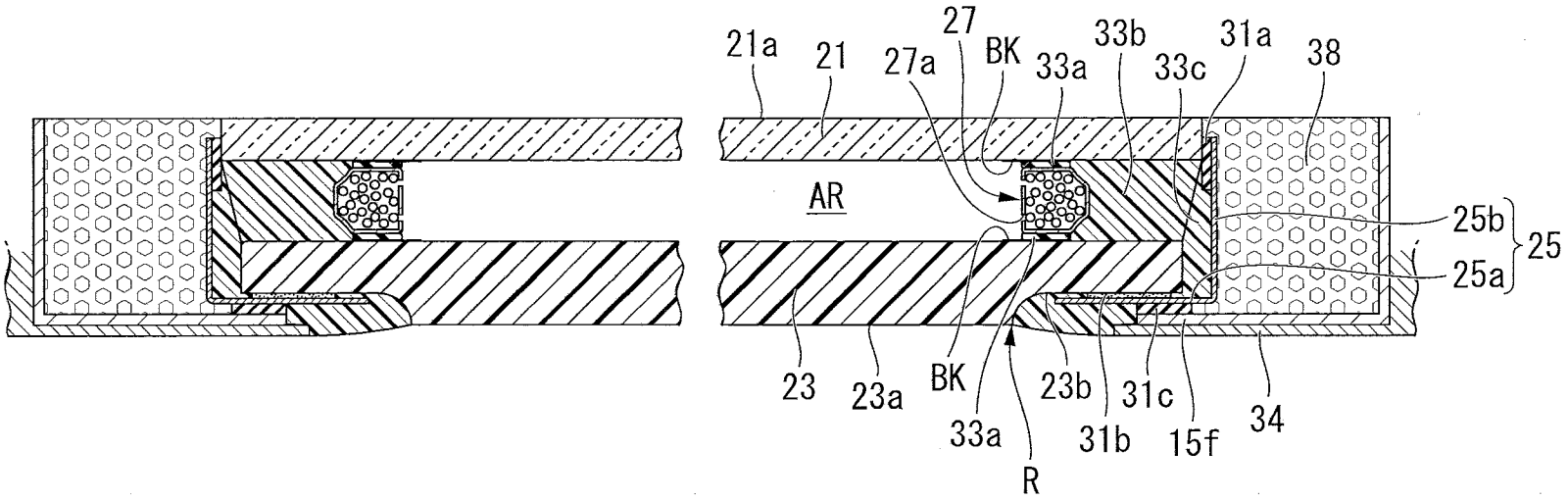
FIG. 3 is a cross-sectional view through line A-A of FIG. 2.
Figure 4:
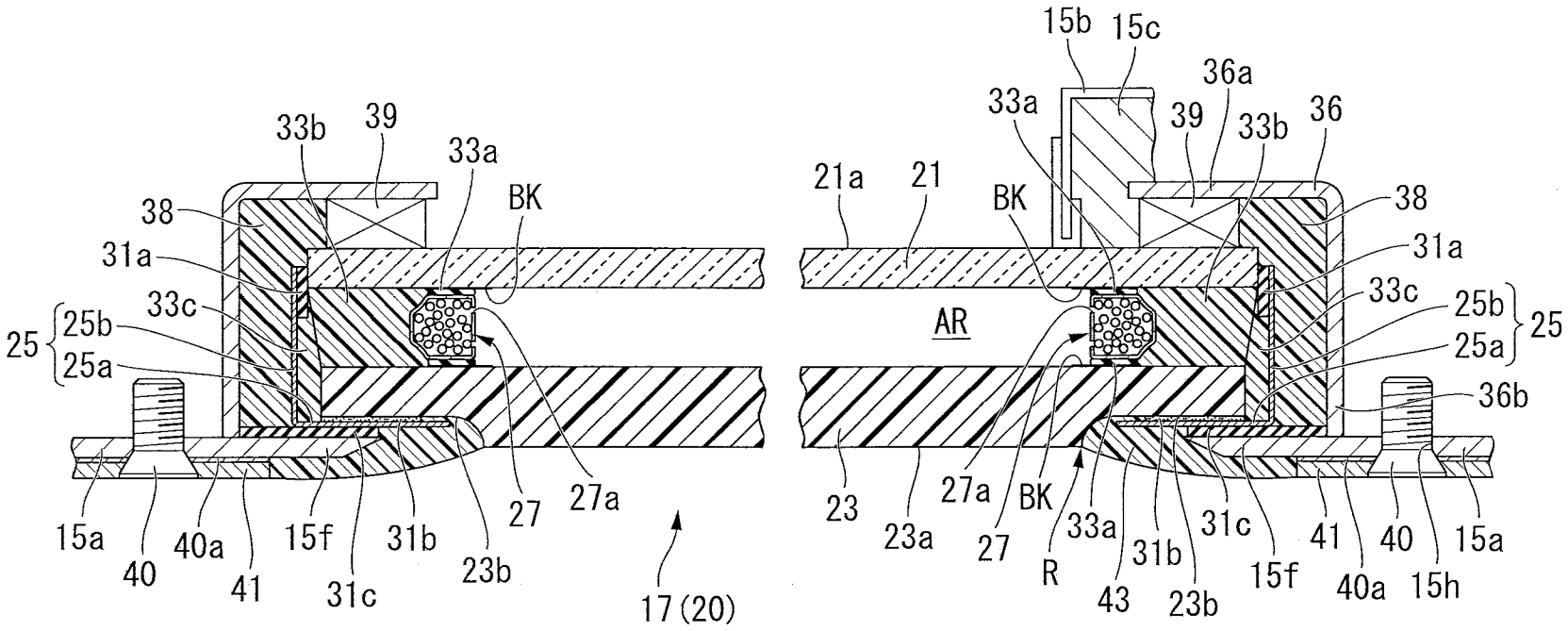
FIG. 4 is a cross-sectional view through line B-B of FIG. 2.
Figure 5:
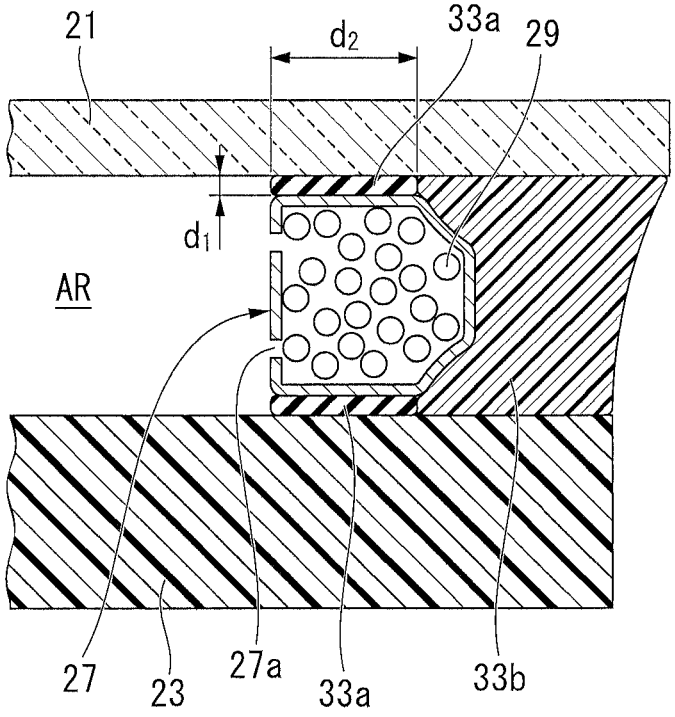
FIG. 5 is a partially enlarged view of FIG. 4.

Next is a description of a multi-layered window structure 20 of the present embodiment. FIG. 2 shows a front view of the window frame panel 15, viewed from the outside. FIG. 3 shows a cross-sectional view through line A-A of FIG. 2. FIG. 4 shows a cross-sectional view through line B-B of FIG. 2. FIG. 5 shows a partially enlarged view of FIG. 4. The multi-layered window structure 20 comprises, schematically, the window frame panel 15 and the multi-layered window unit 17. Hereunder is a detailed description of each.

<Window Frame Panel 15>

As shown in FIGS. 1 and 2, the window frame panel 15 schematically comprises; an outer plate 15*a* disposed on the outside of the car structure 2, an inner plate 15*b* disposed on the inside of the car structure 2, and a rib section 15*c* provided between the outer plate 15*a* and the inner plate 15*b*. Among them, as shown in FIG. 2, an approximately rectangular window opening R is formed in the outer plate 15*a*. Furthermore, as shown in FIGS. 3 and 4, rectangular, annular window retaining sections 15*f* are provided so as to extend along the edges of the window opening R.

As shown in FIGS. 2 and 3, the outer plate 15*a* of the window frame panel 15 and the window retaining sections 15*f* are disposed such that they surround the edges of a first window pane 21 and a second window pane 23, as viewed from the outside of the car structure 2. Furthermore, as shown in FIGS. 2 and 4, window clamping plates 41 are fitted on the outer plate 15*a* on the outside of the car via plate members 40*a*.

As shown in FIGS. 2 and 4, holes 15*h* are provided in two places in each window clamping plate 41, member 40*a*, and outer plate 15*a* for through bolts 40 to pass through. By tightening the bolts 40, the window clamping plates 41 press the second window pane 23 in a direction toward the inside of the car via the members 40*a*, the outer plates 15*a* (window retaining sections 15*f*), third elastic bodies 31*c*, first frame sections 25*a*, and second elastic bodies 31*b*.

Furthermore, as shown in FIG. 2, polyethylene foam backup members 45 are disposed at the four corners of the second window pane 23.

As shown in FIG. 2, clamp supports 34 extend horizontally along the top section and the bottom section of the multi-layered window unit 17. The clamp supports 34 are approximately U-shaped when viewed in cross-section perpendicular to the extending direction, and the ends are welded to the window frame panel 15.

<Multi-Layered Window Unit 17>

As shown in FIGS. 3 and 4, the multi-layered window unit 17 comprises; the first window pane 21, the second window pane 23, spacers 27, primary sealers 33*a*, secondary sealers 33*b*, and first frame members 25. The multi-layered window unit 17 is approximately rectangular, for example, when viewed from the front, and is mounted so as to fill the window opening R.

(First Window Pane 21)

The first window pane 21 is transparent glass having an approximately rectangular shape with approximate height 986 mm×width 2036 mm×thickness 4 mm, for example. The first window pane 21 is disposed so as to face the second window pane 23, and when the multi-layered window structure 20 is mounted on the railroad car 1, it is installed on the inside of the car.

(Second Window Pane 23)

The second window pane 23 is an approximately rectangular window pane comprising transparent polycarbonate, with approximate height 984 mm×width 2033 mm×thickness 8 mm, for example. When the multi-layered window structure 20 is mounted on the railroad car 1, the second window pane 23 is disposed on the outside of the car.

The edge portions (stepped surface 23*b*) of the second window pane 23 are formed to a thickness of 5 mm over a 185 mm wide strip, for example, and 3 mm thinner than the central part of the second window pane 23. Between the edge portions (stepped surfaces 23*b*) of the second window pane 23 and the window retaining sections 15*f*, the second elastic bodies 31*b* being rubber plates are disposed, and furthermore, a silicone quaternary sealer 43 is applied so as to cover the gaps.

Moreover, the second window pane 23 is disposed approximately 8 mm apart from the first window pane 21, and a sealed air layer AR is formed between the two.

As shown in FIGS. 3 and 4, the second window pane 23 is formed smaller in both height and width than the first window pane 21. Therefore, even if the second window pane 23 expands thermally, the edge portions of the second window pane 23 do not protrude outside of the edge portions of the first window pane 21. As a result, it is possible to prevent distortion of the edge portions of the second window pane 23 due to thermal expansion, and also to prevent stress on the primary sealers 33*a*. That is, since a space can be ensured around the edge portions of the second window pane 23 to allow thermal expansion of the second window pane 23, movement of the edge portions of the second window pane 23 when it expands thermally is not restricted. Therefore, it is possible to prevent distortion from occurring in the edge portions. Furthermore, since the primary sealers 33*a* are not stretched significantly, it is possible to prevent cracks or tears from occurring.

It is preferable that the second window pane 23 of the present embodiment is formed to a thickness of 5 mm to 30 mm. If the thickness of the second window pane 23 is less than 5 mm, moisture is likely to permeate through the second window pane 23, and as a result, since the humidity of the air layer AR increases, condensation is likely to occur between the first window pane 21 and the second window pane 23. Furthermore, if the thickness of the second window pane 23 exceeds 30 mm, the size of the window clamping plates 41 and the window retaining sections 15*f* become too large, causing the weight of the multi-layered window structure 20 to increase, which is not desirable.

Moreover, regarding the second window pane 23 of the present embodiment, the center of the second window pane 23 is curved such that it protrudes toward the outside of the car by 0.1 mm to 3.0 mm under temperature conditions of 18° C. to 25° C. By constructing the second window pane 23 in this manner, the second window pane 23 does not curve to the inside (first window pane 21 side) even if the second window pane 23 expands and contracts due to thermal expansion. As a result, the second window pane 23 and the first window pane 21 do not make contact due to the expansion and contraction of the second window pane 23.

Furthermore, it is preferable that a black section BK being a black coating film is formed on the edge portions of the inside (first window pane 21 side) of the second window pane 23. In this case, the sunlight radiating on the primary sealer 33*a*, which is described later, is blocked.

(Spacer 27)

As shown in FIG. 5, the spacer 27 is a hollow annular shape with a cross-sectional shape of approximate height 7 mm×width 7 mm, for example, and is disposed between the first window pane 21 and the second window pane 23. The spacer 27 is adhered to the first window pane 21 and the second window pane 23 via the primary sealers 33*a*, and extends along the edges of the first window pane 21 and the second window pane 23. As a result, the spacer 27, the first window pane 21, and the second window pane 23 are unified, forming an air layer AR between the first window pane 21 and the second window pane 23.

A plurality of holes 27*a* is formed in the side wall on the air layer AR side of the spacer 27 to connect the spacer 27 interior and the air layer AR. Moreover, the spacer 27 interior is packed with desiccating agent 29 to dehumidify the air layer AR. By packing the spacer 27 interior with desiccating agent 29, the desiccating agent 29 removes the moisture in the air layer AR through the holes 27*a*.

(Primary Sealer 33*a*)

As shown in FIG. 5, one primary sealer 33*a* is respectively disposed between the first window pane 21 and the spacer 27, and between the second window pane 23 and the spacer 27. The primary sealer 33*a* is an elastic body, extends along the edges of the first window pane 21 and the second window pane 23, and is in contact with the side surfaces of the spacer 27. By means of such a construction, the spacer 27, the first window pane 21, and the second window pane 23 are unified.

As shown in FIG. 5, it is preferable that the cross-sectional shape of the primary sealer 33*a* has a thickness $d_1$ of 0.5 mm or more, and a width $d_2$ of 6 mm or more. Here the cross-sectional shape of the primary sealer 33*a* is for example approximately a thickness $d_1$ of 0.5 mm and a width $d_2$ of 6 mm. While a conventional primary sealer 33*a* is formed with approximately a thickness $d_1$ of 0.3 mm and a width $d_2$ of 3 mm for manufacturability, the primary sealer 33*a* of the present embodiment is formed to the dimensions in the above-described range, so that the extents of expansion and contraction are greater than that of the conventional one.

Therefore, even if the edge portion of the second window pane 23 is distorted by thermal expansion, and stress is applied to the primary sealer 33*a*, it is not likely to peel off or crack. As a result, moisture is prevented from permeating into the air layer AR, which prevents condensation from occurring between the first window pane 21 and the second window pane 23.

Moreover, it is preferable to use isobutylene-isoprene rubber for the material of the primary sealer 33*a*. Since isobutylene-isoprene rubber excels in resistance to humidity, it can prevent moisture from permeating the primary sealer 33*a*. Furthermore, since isobutylene-isoprene rubber has high elasticity, cracks or tears are unlikely to occur in the primary sealer 33*a*.

(Secondary Sealer 33*b*)

As shown in FIG. 5, the secondary sealer 33*b* being an elastic body is disposed between the first window pane 21 and the second window pane 23. Moreover, the cross-sectional shape of the secondary sealer 33*b* is trapezoidal. The width on the first window pane 21 side is approximately 15 mm, the width on the second window pane 23 side is approximately 13.5 mm, and the height is approximately 8 mm. Furthermore, the secondary sealer 33*b* is in contact with and extends along the edges of the first window pane 21 and the second window pane 23, and is also contact with a periphery of the spacer 27 so as to surround the spacer 27. As a result, all of the edge portions of the primary sealers 33*a* and spacer 27 are covered by the secondary sealer 33*b*.

(First Frame Member 25)

As shown in FIGS. 3 and 4, the first frame member 25 is a rectangular member made of aluminum alloy, and is disposed such that it surrounds the edges of the first window pane 21, the second window pane 23, and the secondary sealer 33*b*. The cross-section of the first frame member 25 is L-shaped, and comprises; a first frame section 25*a* which overlaps the rim (stepped surface 23*b*) on the outer surface 23*a* of the second window pane 23 via the second elastic bodies 31*b*, and a second frame section 25*b* which extends in a direction perpendicular to the first window pane 21 from the outside edge of the first frame section 25*a*.

The first frame section 25*a* of the first frame member 25 is disposed on the inner side of the outer plate 15*a* and the window retaining section 15*f* via the third elastic bodies 31*c*. A second elastic body 31*b* is disposed between the first frame section 25*a* and the second window pane 23.

A first elastic body 31*a* is disposed between the second frame section 25*b* and the first window pane 21. A silicone tertiary sealer 33*c* is disposed between the second frame section 25*b* and the secondary sealer 33*b*.

By means of such a construction, the first window pane 21, the second window pane 23, the primary sealer 33*a*, the spacer 27, the secondary sealer 33*b*, the first frame member 25, and the tertiary sealer 33*c* are unified to construct the multi-layered window unit 17.

A second frame member 36, whose cross-section is substantially L-shaped, extends along the outer plate 15*a* in the vertical direction. Furthermore, the cross-sectional shape of an inside edge section 36*a* of the second frame member 36 is approximately 20 mm long for example, and clamps the inner surface 21*a* of the first window pane 21 via a liner 39 being a rubber strip. Moreover, the cross-sectional shape of an outside edge section 36*b* of the second frame member 36 is approximately 23 mm long for example, and a silicone quaternary sealer 38 fills between this and the second frame section 25*b*.

By means of such a construction, the multi-layered window unit 17 is clamped and held from the two surfaces of the inner surface 21*a* of the first window pane 21 and the outer surface 23*a* (stepped surface 23*b*) of the second window pane 23, by the second frame member 36 and the outer plate 15*a*.

According to the multi-layered window structure 20 of the present embodiment, which has the construction as described above, by forming the second window pane 23 made of polycarbonate smaller in both height and width than the first window pane 21 comprising glass, the width of deformation of the edge portion when the second window pane 23 expands thermally can be kept to a minimum. Furthermore, by forming the second window pane 23 to a thickness of 5 mm to 30 mm, which is thicker than a conventional second window pane, it is possible to prevent moisture from permeating into the air layer AR. Moreover, by forming the cross-sectional shape of the primary sealer 33*a* to a thickness of 0.5 mm or more and a width of 6 mm or more, which is greater than a conventional primary sealer 33, it is possible to prevent cracks or tears from occurring in the primary sealer 33*a* even if stress is applied to the primary sealer 33*a* accompanying thermal expansion of the second window pane 23. As a result, it is possible to prevent permeation of moisture through the second window pane 23, and permeation of moisture due to cracks or tears in the primary sealer 33*a*.

Since the second window pane 23 is arranged such that the center CP of the second window pane 23 is curved such that it protrudes toward the outside of the car by 0.1 mm to 3.0 mm under temperature conditions of 18° C. to 25° C., then even if the second window pane 23 expands or contracts due to thermal expansion, the second window pane 23 does not curve to the inside (first window pane 21 side). As a result, outside heat is not directly transmitted through the second window pane 23 to the first window pane 21, so that it is possible to prevent condensation due to contact of the first window pane 21 and the second window pane 23 from occurring.

Furthermore, by forming the black section BK being a black coating film on the edge portion of the inside (first window pane 21 side) of the second window pane 23, it is possible to prevent the primary sealer 33*a* from deteriorating due to solar radiation. As a result, it is possible to prevent cracks from occurring in the primary sealer 33*a*, and it is also possible to extend its useful life.

Moreover, by packing the spacer interior with desiccating agent 29, the moisture in the air layer AR passes through the holes 27*a* and is removed by the desiccating agent 29. As a result, it is possible to prevent condensation from occurring between the first window pane 21 and the second window pane 23.

Furthermore, by using a flexible isobutylene-isoprene rubber for the material of the primary sealer 33*a*, cracks or tears in the primary sealer 33*a* can be prevented. As a result, it is possible to prevent condensation from occurring between the first window pane 21 and the second window pane 23.

By covering the edge portions of the primary sealer 33*a* and the spacer 27 by the secondary sealer 33*b*, it is possible to prevent moisture from permeating to the air layer AR. Moreover, by supporting the edge side of the spacer 27 by the secondary sealer 33*b*, it is possible to prevent cracks or tears in the primary sealer 33*a*. As a result, it is possible to prevent condensation from occurring between the first window pane 21 and the second window pane 23.

As described above, it is possible to prevent condensation from occurring between the first window pane 21 and the second window pane 23.

EXAMPLE

Hereunder the present invention is described specifically, based on an example. However, the present invention is not limited to the example.

Example 1

In example 1, a multi-layered window structure 20 having the construction described in the above embodiment was manufactured. The conditions of the construction of a multi-layered window unit 17 comprising the multi-layered window structure 20 were as follows.

For a first window pane 21, a substantially rectangular transparent glass of height 986 mm×width 2036 mm×thickness 4 mm was used. For a second window pane 23, a substantially rectangular window pane of height 984 mm×width 2033 mm×thickness 8 mm, made of transparent polycarbonate, was used. The edge portion (stepped surface 23*b*) of the second window pane 23 was 5 mm thick over a 185 mm wide strip, and was formed to be 3 mm thinner than the central part of the second window pane 23. Furthermore, under conditions of 18° C. to 25° C., the center CP of the second window pane 23 was curved such that it protruded away from the first window pane 21, by 0.1 mm to 3.0 mm in relation to the periphery of the second window pane 23.

Moreover, a hollow annular spacer 27 whose cross-sectional shape was approximately 7 mm high×7 mm wide was disposed between the first window pane 21 and the second window pane 23. A plurality of holes 27*a* was provided in the spacer 27, and desiccating agent 29 was packed inside.

A primary sealer 33*a* made of isobutylene-isoprene rubber, whose cross-sectional shape was 0.5 mm thick and 6 mm wide, was disposed between the first window pane 21 and the spacer 27, and between the second window pane 23 and the spacer 27, and thus the spacer 27, the first window pane 21 and the second window pane 23 were unified. Furthermore, a secondary sealer 33*b* made of isobutylene-isoprene rubber was disposed between the first window pane 21 and the second window pane 23, around the edge portion of the spacer 27.

Using the multi-layered window structure 20 having a multi-layered window unit 17 manufactured under the above conditions, accelerated life tests were performed to a JIS standard (JIS R 3209) for multi-layered glass. Table 1 shows the results.

TABLE 1

| Test Level | Moisture & Light Resistance Test | Thermal Cycling Test | Comments | Condensation |
|---|---|---|---|---|
| Group 1 | 7 Days | 12 Cycles | — | None |
| Group 2 | 7 Days | 12 Cycles | Performed following group 1 | None |
| Group 3 | 28 Days | 48 Cycles | Performed following group 2 | None |

Figure 6:
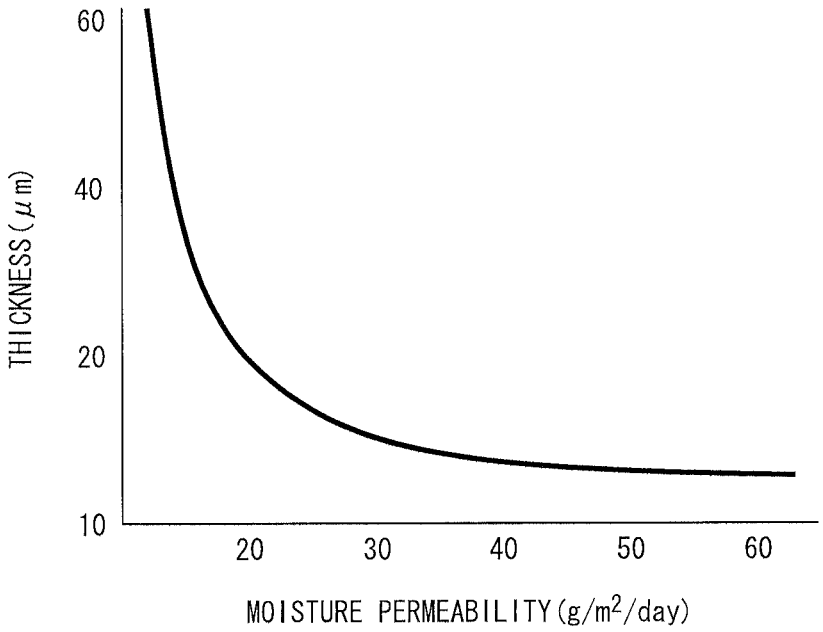
FIG. 6 is a graph showing the relationship between the thickness of the window pane and moisture permeation.

As shown in Table 1, in the multi-layered window structure 20 of the present embodiment, even though the first, second, and third groups of tests were performed in succession, no condensation occurred. Furthermore, as shown in FIG. 6, when the relationship between the thickness of the second window pane 23 and the moisture permeability was examined, it was confirmed that moisture hardly permeated within the range of thicknesses of the second window pane 23 of the present embodiment.

INDUSTRIAL APPLICABILITY

A multi-layered window structure of the preset invention can be used not only for railroad cars, but also for vehicles and ships.

BRIEF DESCRIPTION OF THE REFERENCE SYMBOLS

1 Railroad car
2 Car structure
3 Roof structure
5 Side structure
7 Underframe
9 End structure
13 Upper panel
15 Window frame panel
15*a* Outer plate
15*b* Inner plate
15*c* Rib section
15*f* Window retaining section
15*h* Hole
17 Multi-layered window unit
19 Lower panel

20 Multi-layered window structure
21 First window pane
21*a* Inner surface of first window pane
23 Second window pane
23*a* Outer surface of second window pane
23*b* Stepped surface
25 First frame member
25*a* First frame section
25*b* Second frame section
27 Spacer
31*a* First elastic body
31*b* Second elastic body
31*c* Third elastic body
33*a* Primary sealer
33*b* Secondary sealer
33*c* Tertiary sealer
36 Second frame member
36*a* Inside edge section
36*b* Outside edge section
38 Quaternary sealer
40 Bolt
40*a* Member
41 Window pressing plate
43 Quaternary sealer
R Window opening
SP Space
BK Black section
AR Air layer
$d_1$ Thickness
$d_2$ Width
CP Center of window pane

The invention claimed is:

1. A multi-layered window structure comprising:

a first window pane made of a glass;

a second window pane made of a polycarbonate, being smaller in both height and width than the first window pane;

a hollow annular spacer disposed so as to extend along edges of the first window pane and the second window pane, and having holes in a side wall facing an air layer between the first window pane and the second window pane; and primary sealers formed of elastic bodies, each of said primary sealers having a thickness of 0.5 mm or more and having a width of 6 mm or more, the primary sealers also extending along the edges of the first window pane and the second window pane, and being disposed between the first window pane and the spacer, and between the second window pane and the spacer, wherein the second window pane includes:

an inner surface which is opposite to the first window pane;

an outer surface on a side of the second window pane opposite the inner surface, the outer surface being a stepped surface defined by:

a thick plate section having a thickness of 5 mm to 30 mm; and a thin plate section which is formed so as to surround a periphery of the thick plate section, which shares and is flush with the inner surface of the second window pane with the thick plate section, and which has a thickness smaller than that of the thick plate section, and wherein the spacer is disposed at a position between the thin plate section of the second window pane and the first window pane, the position being a position closest to the thick plate section.

2. The multi-layered window structure according to claim 1, wherein the spacer is packed with a desiccating agent.

3. The multi-layered window structure according to claim 2, wherein within a temperature condition of 18° C. to 25° C., only the second window pane is curved and the first window pane is not curved.

4. The multi-layered window structure according to claim 1, wherein the primary sealer is made of an isobutylene-isoprene rubber.

5. The multi-layered window structure according to claim 4, wherein within a temperature condition of 18° C. to 25° C., only the second window pane is curved and the first window pane is not curved.

6. The multi-layered window structure according to claim 1, further comprising a secondary sealer made of an elastic body, that is in contact with and extends along the edges of the first window pane and the second window pane, and is also contact with the spacer so as to surround a periphery of the spacer.

7. The multi-layered window structure according to claim 6, wherein within a temperature condition of 18° C. to 25° C., only the second window pane is curved and the first window pane is not curved.

8. The multi-layered window structure according to claim 1, wherein a black coating film is formed on the edge, on the air layer side, of the second window pane.

9. The multi-layered window structure according to claim 8, wherein within a temperature condition of 18° C. to 25° C., only the second window pane is curved and the first window pane is not curved.

10. The multi-layered window structure according to claim 1, wherein within a temperature condition of 18° C. to 25° C., only the second window pane is curved and the first window pane is not curved.

11. The multi-layered window structure according to claim 1, wherein the thickness of the second window pane is 8 mm to 30 mm.

12. The multi-layered window structure according to claim 1, further comprising:

a first frame member having a first frame section and a second frame section, an outside edge portion that is formed on the outer surface of the second window pane;

a first elastic body that is disposed between the second frame section and the first window pane; and a second elastic body that is disposed between the first frame section and the second window pane, wherein the first frame section overlaps the edge portion via the second elastic body, the second frame section extends in a direction perpendicular to the first window pane from an outside edge of the first frame section and overlaps the first window pane via the first elastic body, and the first window pane, the second window pane, the primary sealer, the spacer, and the first frame member are unified.

13. The multi-layered window structure according to claim 12, further comprising:

a secondary sealer made of an elastic body, said secondary sealer being in contact with and extending along the edges of the first window pane and the second window pane, and the secondary sealer also being in contact with the spacer so as to surround a periphery of the spacer; and a tertiary sealer disposed among the first frame section, the secondary sealer, and the second window pane.

14. The multi-layered window structure according to claim 1, wherein the multi-layered window structure is a double layer structure consists of the first window pane and the second window pane, and an inner surface of the first window pane, the inner surface of the second window pane, and an inner surface of the spacer form an air gap.

* * * * *